US005887757A

United States Patent [19]

Jenkins et al.

[11] Patent Number: 5,887,757

[45] Date of Patent: Mar. 30, 1999

[54] ROTARY ANGLED NOZZLE FOR HEATED FLUID DISPENSERS

[75] Inventors: Thomas C. Jenkins, Amherst, Ohio; William A. Lewis, Lilburn, Ga.

[73] Assignee: Nordson Corporation, Westlake, Ohio

[21] Appl. No.: 791,919

[22] Filed: Jan. 31, 1997

[51] Int. Cl.[6] ..... B05B 1/00

[52] U.S. Cl. ..... 222/146.2; 222/48; 222/568; 239/587.1; 239/587.5

[58] Field of Search ..... 222/48, 113, 146.2, 222/146.5, 568; 239/587.1, 587.5

[56] References Cited

U.S. PATENT DOCUMENTS

| | | | |
|---|---|---|---|
| 2,195,811 | 4/1940 | Bramsen et al. | 239/587.5 |
| 2,535,873 | 12/1950 | Smith | 239/587.5 |
| 2,595,826 | 5/1952 | Winks et al. | 239/587.5 |
| 2,677,416 | 5/1954 | Smith | 239/587.5 |
| 3,004,588 | 10/1961 | Christenson | 239/587.5 |
| 3,332,580 | 7/1967 | Spencer et al. . | |
| 3,334,818 | 8/1967 | Moen | 239/587.1 |
| 3,543,332 | 12/1970 | Wagner et al. . | |
| 4,469,248 | 9/1984 | Petrecca | 222/48 |
| 4,601,427 | 7/1986 | Trevathan et al. | 239/11 |
| 4,690,327 | 9/1987 | Takai et al. | 239/587.5 |
| 4,785,996 | 11/1988 | Ziecker et al. | 239/298 |
| 4,844,003 | 7/1989 | Slautterback et aL. | 118/323 |
| 5,087,484 | 2/1992 | Stewart | 427/239 |
| 5,186,394 | 2/1993 | Tsuji | 239/587.4 |
| 5,197,673 | 3/1993 | Sullivan | 239/102.1 |
| 5,238,190 | 8/1993 | Herke | 239/298 |
| 5,353,447 | 10/1994 | Gravatt | 239/587.1 |
| 5,657,496 | 8/1997 | Corb et al. | 239/587.1 |

OTHER PUBLICATIONS

1994 Adhesives and Sealants Equipment Catalog; Nordson® Corporation.

Model E100™ Automatic Applicator Head; Slautterback Corporation.

Slautterback® Applicator Systems, The World's Most Reliable HotMelt Equipment.

Meltex Information, Hot Melt Nozzles, Guns and Wheels, Meltex® Corporation.

*Primary Examiner*—J. Casimer Jacyna

*Attorney, Agent, or Firm*—Wood, Herron & Evans, LLP

[57] ABSTRACT

A rotatably adjustable angled nozzle for attachment to dispenser modules which deposit melted thermoplastic materials such as melted adhesives on a substrate. The nozzle has a nozzle body permanently and rotatably attached to a connector nut which threadably engages an outlet nipple of an adapter fitting on a fluid dispenser module and is tightened securely to sealingly seat against the outlet end of the nipple. The nozzle body has a transverse bore in communication with an axial bore and having one end in communication with a nozzle tip and orifice. Rotation of the nozzle body changes the angle of the transverse bore and changes the direction of the stream of fluid emitted by the nozzle tip. The nozzle body can be rotated relative to the nut with a single tool without rotation of the nut. The transverse bore can be at right angles to the axial bore or can be at any other desired angle of inclination.

29 Claims, 2 Drawing Sheets

ROTARY ANGLED NOZZLE FOR HEATED FLUID DISPENSERS

FIELD OF THE INVENTION

This invention relates to rotatably adjustable angled nozzles for attachment to dispenser modules which deposit melted thermoplastic materials such as melted adhesives on a substrate.

BACKGROUND OF THE INVENTION

Various kinds of nozzles have been used in the past on dispenser modules for melted thermoplastic materials such as adhesives and other melted materials. Such heated liquid materials are often referred to as "hot melt materials" and are materials which are solid at room or ambient temperature but, when heated, convert to a liquid state.

The nozzle configuration and adjustability is dependent upon the particular application for which the nozzle is to be used. It is known to use nozzles which may be rotatably adjustable about an axis and which have nozzle outlet orifices which direct a stream of melted fluid material at some predetermined angle which is inclined to the axis of rotation of the body of the nozzle.

An example of such prior nozzle is shown in U.S. Pat. No. 4,469,248 issued to P. J. Petrecca. The nozzle shown in the Petrecca patent is attached to a threaded outlet nipple of a fluid dispenser module by a connector nut which is tightened on the nipple until a rotatable body of the nozzle is drawn into such tight contact with an end of the outlet nipple that the nozzle body cannot be rotated without slightly loosening the nut. Adjusting such nozzle requires two tools, with one tool engaging the nut and the other tool engaging the rotary nozzle body. To adjust the nozzle the nut is first loosened slightly with a wrench and the nozzle body is moved to the desired rotational position with a second tool such as a screwdriver. The nozzle body is then held in the desired adjusted position by the screwdriver while the nut is retightened on the outlet nipple with the wrench.

Once the nut is securely tightened, the nozzle body is drawn tightly against the end of the nipple, thereby locking the nozzle body in the adjusted position and preventing it from turning unless the nut is loosened.

In addition the rotary nozzle body in the Petrecca patent is secured to the connector nut by a lock ring which fits in an annular groove in the nut and engages a radially outwardly extending flange on nozzle body. If the nut is tightened too far on the outlet nipple, the lock ring can become deformed, thereby causing leakage between the nut and the nozzle body.

The present invention eliminates the need for using two tools by providing such an interface between the nut the nozzle body, and the outlet nipple that the nozzle body is spaced from the outlet nipple so that it can be rotated with a single tool without loosening the nut and without requiring a second tool to loosen and tighten the nut. In the present invention the rotary nozzle body is retained by a radially inwardly extending flange on the nut rather than a lock ring and a resilient O-ring seal is located under radial compression between the nozzle body and the nut. The radially inwardly extending flange on the nut contacts the end of the outlet nipple and prevents overtightening of the nut to cause contact between the nipple and the nozzle body.

OBJECTS OF THE INVENTION

A primary object of this invention is to provide a rotary nozzle for a melted fluid dispenser which can be rotated with a single tool without loosening a connector nut which attaches the nozzle to a fluid dispenser module.

Another object of this invention is to provide a rotary nozzle for a melted fluid dispenser which has a retaining nut which can be tightened securely against a seating surface of a threaded output nipple to provide a metal to metal seal between the nut and the nipple.

A still further object of this invention is to provide a rotary nozzle for a melted fluid dispenser which nozzle has a retaining nut rotatably and permanently secured to the nozzle body, with the nut and nozzle body being in sealing engagement with each other.

These and other objects of the invention will become more fully apparent from the description in the following specification and the attached drawings.

SUMMARY OF THE INVENTION

This invention is a rotary angled nozzle for a heated fluid dispenser comprising: a connector nut for attachment to an outlet nipple of a heated fluid dispenser, a rotary nozzle body having one end permanently rotatably secured within the nut and rotatable with respect to the nut about a common axis therewith, and an opposite end of the body extending outside the nut, the opposite end of the nozzle body having an outlet nozzle tip therein for directing a stream of fluid at an inclined angle to the common axis of the housing and the nut, the nozzle body having a fluid passageway connecting the nozzle tip and an outlet opening on the outlet nipple to permit fluid to flow from the outlet opening of the nipple and through an outlet orifice of the nozzle tip, and seal means between the nozzle body and the nut to prevent fluid from leaking from between the nut and the body while permitting the nozzle housing to be rotated relative to the nut.

DESCRIPTION OF THE DRAWINGS

In order to more clearly show the details of the parts in this device, both FIGS. 2 and 3 are greatly enlarged from the actual size of the nozzle as produced.

DESCRIPTION OF THE PREFERRED EMBODIMENTS

The rotary nozzle of this invention is for use on the output port of a dispenser gun which deposits melted fluid material on a substrate. Such deposits can be in the form of a continuous line or lines, interrupted spots or other configuration. The melted material is typically an adhesive referred to as a "hot melt material", as previously described, however the nozzle can also be used with other applications of other melted materials.

Figure 1:
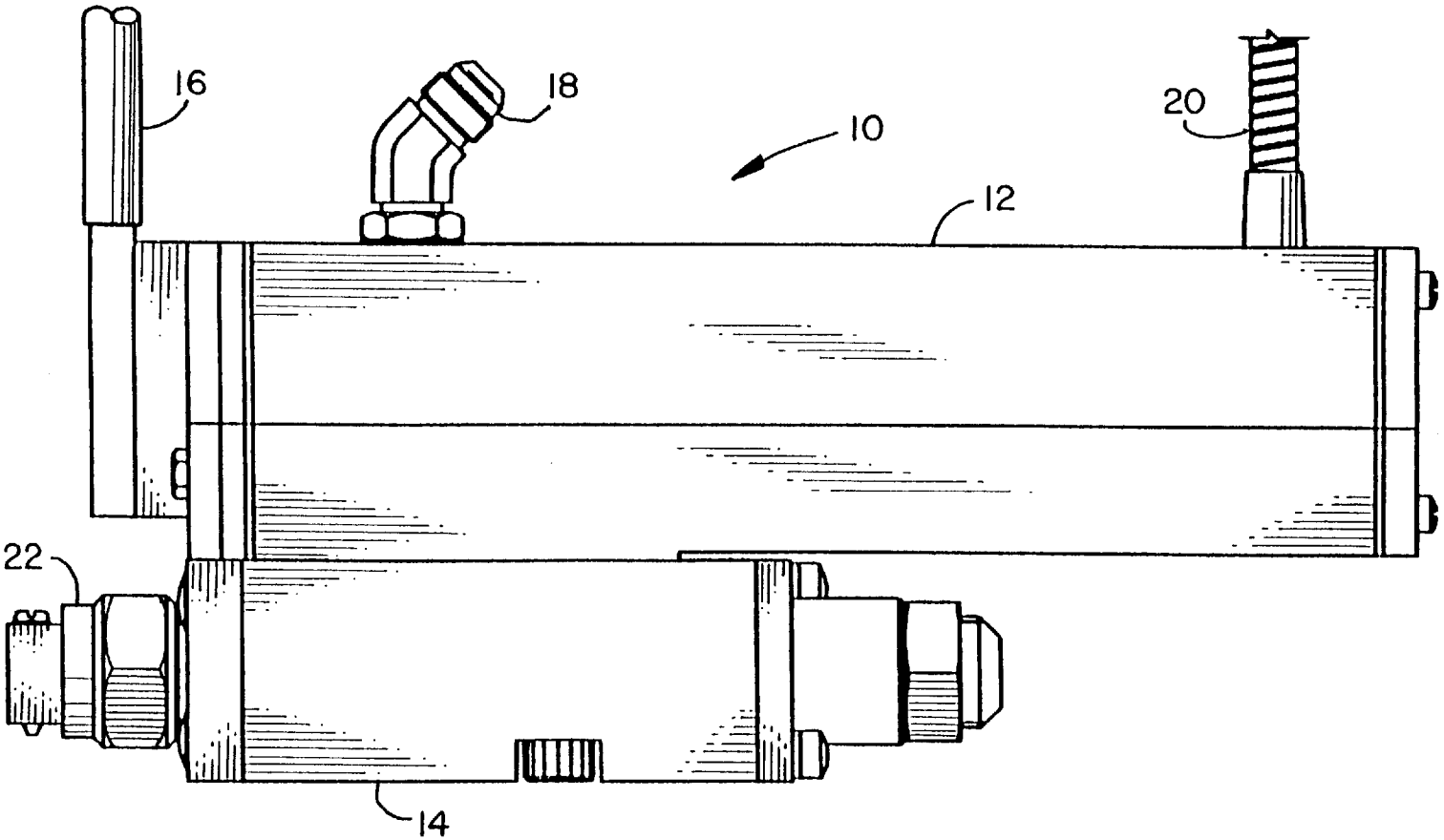
FIG. 1 is a side elevational view of a dispenser gun for depositing a melted fluid material on a substrate showing a swivel nozzle positioned on a dispenser module of the dispenser gun.

Referring now to the drawings FIG. 1 shows a "hot melt" dispenser gun 10 having a gun body 12 and a dispenser module 14 connected thereto. The gun has a mounting bracket 16, a hose fitting 18 and a cord set 20. These parts of the gun will not be described further since they are not part of the invention which is the rotary nozzle 22 which is attached to one end of the dispenser module 14.

Figure 3:
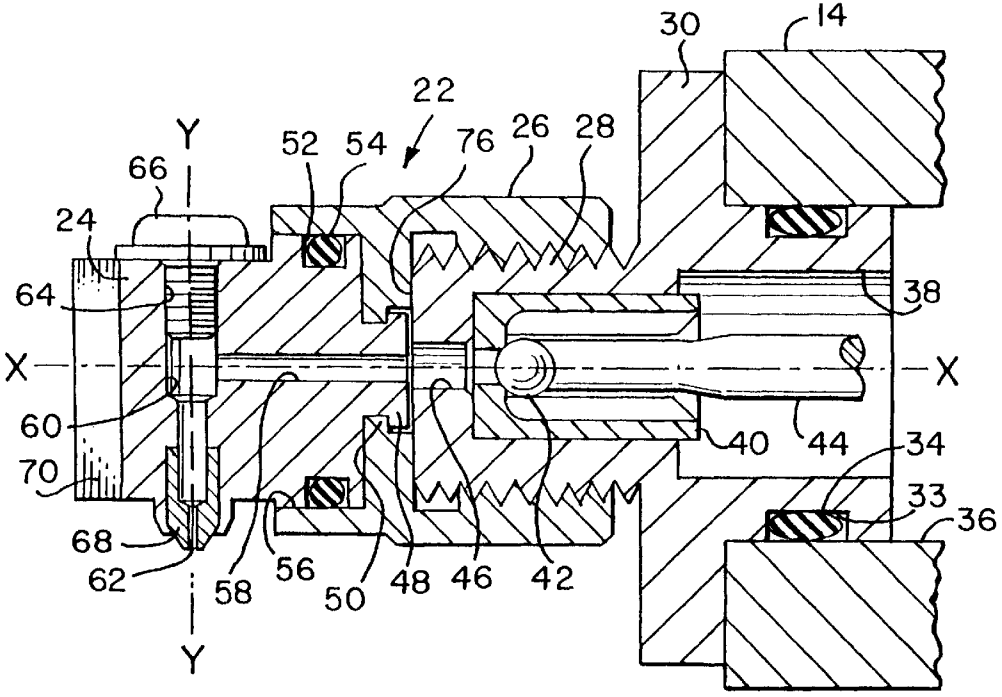
FIG. 3 is a cross-sectional view of the rotary nozzle and adapter fitting taken on line 3—3 of FIG. 2.
Figure 2:
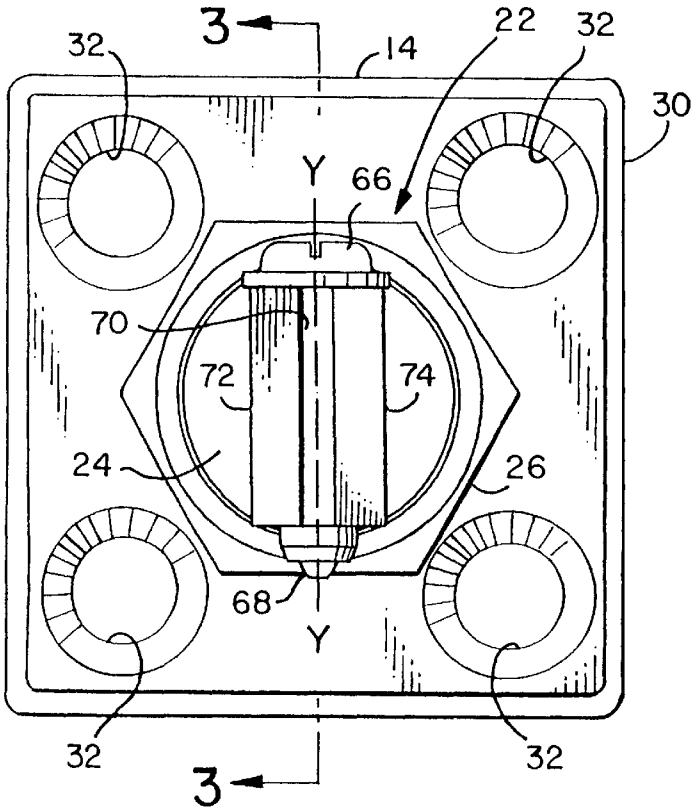
FIG. 2 is an end view of the rotary nozzle of the invention attached to an adapter fitting.

Referring now to greatly enlarged FIGS. 2 and 3, the nozzle 22 has a rotary nozzle body 24 which is permanently and rotatably attached to a connector nut 26 which threadably engages an outlet nipple 28 on an adapter fitting 30. The adapter fitting 30 has a plurality of holes 32 which receive screws, not shown which screw into threaded holes in an end of the dispenser module 14. The adapter 30 has an annular groove 33 which carries an O-ring 34 for sealing engagement with a bore 36 of the dispenser module 14.

The adapter 30 has an axial bore 38 and a valve bushing 40 mounted therein. A ball 42 carried on a needle 44 controls the flow of fluid through outlet port 46 of the adapter 30 and into the nozzle body 24.

The nut 26 and the nozzle body 24 are permanently and rotatably attached together by means of a radially outwardly extending annular flange 48 on the body 24 which engages a radially inwardly extending annular flange 50 on the nut 26. The flange 48 is orbitally formed after the nozzle body 24 has been inserted inside the nut 26. This flange 48 permanently rotatably fastens the nozzle body 24 and nut 26 together.

The nozzle body has a circumferential groove 52 which carries an O-ring 54 which seals against a radially inner surface 56 of the nut 26 and prevents fluid from leaking between and nut 26 and the nozzle body 24.

The nozzle body has an axial bore 58 which lies on axis X—X which forms a common axis for both the body 24 and the nut 26. The bore 58 hydraulically communicates with the outlet port 46. A transverse bore 60 lying on an axis Y—Y, extends across the body 24 in communication with the bore 58. One end of the bore 60 communicates with the nozzle outlet orifice 62 and the opposite end has a threaded portion 64 which is closed by a screw 66. The nozzle orifice 62 is in a nozzle tip 68 which is crimped in place in the nozzle body 24.

The nozzle body 24 has a transverse slot 70 to receive the tip of a screwdriver for rotating the nozzle body 24. The body 24 also has two transverse flat sides 72 and 74 for engaging a wrench as an alternative means of rotating the body 24.

As shown in FIG. 3 the nut 26 is tightly screwed onto the nipple 28 until it seats against a seat surface 76 on the end of a nipple and makes sealing metal to metal contact therewith. With the nut 26 firmly seated on the seat surface 76 there is still a clearance between seat surface 76 and the flange 48 of the nozzle body 24. This clearance enables the nozzle body 24 to be rotated without rotating or loosening the nut 26.

While it is needed for the nozzle body 24 to be rotatable by use of a tool to adjust the relative angle of output stream of the nozzle, the nozzle body 24 should not rotate freely but will remain at the angle it has been moved to. This is accomplished due to the resistance caused by the O-ring 54 and the tight connection between the body 24 and nut 26 at flanges 48 and 50. The body 24 will therefore remain at the rotational position where it has been set until moved by exerting a rotational force by a tool on the body 24.

While the nozzle stream axis Y—Y is shown in FIG. 3 as being at right angles to the X—X axis of rotation of the nozzle body 24, it should be understood that the Y—Y axis could be inclined at various other angles with respect to the X—X axis depending upon the particular application in which the nozzle is being used.

The nozzle body 24 is made preferably from stainless steel since this provides corrosion resistance without any need for surface plating and provides a strong material for the orbitally formed joint between the nozzle body 24 and the nut 26.

The nut 26 is made preferably of brass and the adapter 30 is made of nickel plated brass. Brass is preferable due to its high heat transfer properties.

Other metals can also be used provided they have sufficient strength and other required physical characteristics.

It should be understood that many variations can be made in the shape and relative sizes of the parts of this device and various other modifications can be made in the device shown herein without departing from the scope of the invention.

We claim:

1. A rotary angled nozzle for a heated fluid dispenser comprising:

a threaded connector nut for attachment to an outlet nipple of a heated fluid dispenser;

the nut having a radially inwardly extending annular flange on the interior thereof;

the nut adapted to be securely tightened on the outlet nipple with the radially inwardly extending annular flange of the nut cooperating with a seat surface of the outlet nipple to form a fluid seal therebetween;

a rotary nozzle body having one end cooperating with the radially inwardly extending annular flange of the nut to be secured within the nut and rotatable with respect to the nut about a common axis with the nut, and an opposite end of the nozzle body extending outside the nut;

the opposite end of the nozzle body having an outlet nozzle tip therein for directing a stream of fluid at an inclined angle to the common axis of the nozzle body and the nut;

the nozzle body having a fluid passageway for connecting the nozzle tip and an outlet opening on the outlet nipple, when said nut is secured on the outlet nipple, to permit fluid to flow from the outlet opening of the nipple and through an outlet orifice of the nozzle tip; and a seal member for preventing fluid from leaking from between the nut and the nozzle body.

2. A nozzle as claimed in claim 1 wherein the nozzle body is rotatable within the nut without rotation of the nut on the outlet nipple.

3. A nozzle as claimed in claim 1 wherein the nozzle body is permanently secured to the nut by a radially outwardly extending annular flange which is orbitally formed on the nozzle body to overlap the radially inwardly extending flange within the nut.

4. A nozzle as claimed in claim 1 wherein the nozzle tip is oriented in the nozzle body to direct a fluid stream at right angles to the common axis of the nut and the nozzle body.

5. A nozzle as claimed in claim 1 wherein the seal member is disposed around the nozzle body and resists rotation of the nozzle body with respect to the nut.

6. A nozzle as claimed in claim 5 wherein the seal member disposed around the nozzle body is an O-ring of resilient material.

7. A nozzle as claimed in claim 1 wherein the nozzle body is shaped to receive a tool for rotating the nozzle body relative to the nut.

8. A nozzle as claimed in claim 7 wherein the nozzle body has a slot therein for receiving a screwdriver to rotate the nozzle body.

9. A nozzle as claimed in claim 7 wherein the nozzle body has at least two opposed flat surfaces for being engaged by a wrench to rotate the nozzle body.

10. A nozzle as claimed in claim 1 wherein a surface of the radially inwardly extending flange of the nut is operable to engage the seat surface of the outlet nipple to prevent leakage of fluid between the nut and the outlet nipple.

11. A nozzle as claimed in claim 10 wherein the seal between the nut and the outlet nipple is formed by metal to metal contact.

12. A rotary angled nozzle for a heated fluid dispenser comprising:

an integral connector nut for attachment to an outlet nipple of a heated fluid dispenser;

the nut having a first portion internally threaded for engaging the outlet nipple, and a second portion axially aligned therewith having an unthreaded hole therethrough;

the nut having a radially inwardly extending annular flange on the interior thereof positioned between the first and second portions;

a rotary nozzle body having one end permanently coupled with the radially inwardly extending annular flange of the nut to be rotatably secured within the unthreaded hole in the second portion of the nut and rotatable with respect to the nut about a common axis therewith, and an opposite end of the nozzle body extending outside the nut, with the nut and the nozzle body being engageable with and disengageable from the outlet nipple as a unit;

the opposite end of the nozzle body having an outlet nozzle tip therein for directing a stream of fluid at an inclined angle to the common axis of the nozzle body and the nut;

the nozzle body having a fluid passageway connecting the nozzle tip and an outlet opening on the outlet nipple to permit fluid to flow from the outlet opening of the nipple and through an outlet orifice of the nozzle tip; and a seal member for sealing against an interior surface of the unthreaded hole in the nut to prevent fluid from leaking from between the nut and the nozzle body.

13. A nozzle as claimed in claim 12 wherein the nozzle body is rotatable within the nut without rotation of the nut on the outlet nipple.

14. A nozzle as claimed in claim 12 wherein the nozzle body is permanently secured to the nut by a radially outwardly extending annular flange which is orbitally formed on the nozzle body to overlap the radially inwardly extending flange within the nut.

15. A nozzle as claimed in claim 12 wherein the nozzle tip is oriented in the nozzle body to direct a fluid stream at right angles to the common axis of the nut and the nozzle body.

16. A nozzle as claimed in claim 12 wherein the seal member is disposed around the nozzle body and resists rotation of the nozzle body with respect to the nut.

17. A nozzle as claimed in claim 16 wherein the seal member disposed around the nozzle body is an O-ring of resilient material.

18. A nozzle as claimed in claim 12 wherein the nozzle body is shaped to receive a tool for rotating the nozzle body relative to the nut.

19. A nozzle as claimed in claim 18 wherein the nozzle body has a slot therein for receiving a screwdriver to rotate the nozzle body.

20. A nozzle as claimed in claim 18 wherein the nozzle body has at least two opposed flat surfaces for being engaged by a wrench to rotate the nozzle body.

21. A nozzle as claimed in claim 12 wherein a surface of the radially inwardly extending flange of the nut is operable to engage the seat surface of the outlet nipple to prevent leakage of fluid between the nut and the outlet nipple.

22. A nozzle as claimed in claim 21 wherein the seal between the nut and the outlet nipple is formed by metal to metal contact.

23. A rotary angled nozzle for a heated fluid dispenser comprising:

an integral connector nut for attachment to an outlet nipple of a heated fluid dispenser;

the nut having a radially inwardly extending annular flange on the interior thereof;

a rotary nozzle body having one end permanently coupled with the radially inwardly extending annular flange of the nut to be rotatably secured within the nut and rotatable with respect to the nut about a common axis therewith, and an opposite end of the nozzle body extending outside the nut, with the nut and the nozzle body being engageable with and disengageable from the outlet nipple as a unit;

the connector nut retaining the nozzle body at a spaced axial distance from a seat surface of the outlet nipple when the connector nut is tightened on the outlet nipple to form a fluid seal therebetween;

the opposite end of the nozzle body having an outlet nozzle tip therein for directing a stream of fluid at an inclined angle to the common axis of the nozzle body and the nut;

the nozzle body having a fluid passageway connecting the nozzle tip and an outlet opening on the outlet nipple to permit fluid to flow from the outlet opening of the nipple and through an outlet orifice of the nozzle tip; and a seal member disposed between the nozzle body and the nut to prevent fluid from leaking from between the nut and the nozzle body while permitting the nozzle body to be rotated relative to the nut.

24. A nozzle as claimed in claim 23 wherein the seal member disposed between the nozzle body and the nut resists rotation of the nozzle body unless force is exerted thereon.

25. A nozzle as claimed in claim 23 wherein the nozzle body can be rotated by a single tool applied thereto without causing any rotational movement of the nut.

26. A nozzle as claimed in claim 23 wherein the seal member is a resilient O-ring which is under compression in the radial direction between the nozzle body and the connector nut.

27. A nozzle as claimed in claim 23 wherein, when the connector nut is tightened on the outlet nipple, only the connector nut contacts an outlet end of the outlet nipple and the connector nut retains the nozzle body at a spaced distance from such end of the outlet nipple.

28. A rotary angled nozzle for a heated fluid dispenser comprising:

a threaded connector nut for attachment to an outlet nipple of a heated fluid dispenser;

the nut having a radially inwardly extending annular flange on the interior thereof;

the nut adapted to be securely tightened on the outlet nipple with the radially inwardly extending annular flange of the nut cooperating with a seat surface of the outlet nipple to form a fluid seal therebetween;

a rotary nozzle body cooperating with the radially inwardly extending flange of the nut to be secured within the nut and rotatable with respect to the nut about a common axis with the nut;

the nut retaining the nozzle body at a spaced axial distance from the seat surface of the outlet nipple when the nut is tightened on the outlet nipple to form the fluid seal;

the nozzle body having an outlet nozzle tip therein for directing a stream of fluid at an inclined angle to the common axis of the nozzle body and the nut;

the nozzle body having a fluid passageway for connecting the nozzle tip and an outlet opening on the outlet nipple, when said nut is secured on the outlet nipple, to permit fluid to flow from the outlet opening of the nipple and through an outlet orifice of the nozzle tip; and a seal member for preventing fluid from leaking from between the nut and the nozzle body.

29. A rotary angled nozzle for a heated fluid dispenser comprising:

an integral connector nut for attachment to an outlet nipple of a heated fluid dispenser;

a rotary nozzle body having one end permanently coupled with the nut to be rotatably secured within the nut and rotatable with respect to the nut about a common axis therewith, and an opposite end of the nozzle body extending outside the nut, with the nut and nozzle body being engageable with and disengageable from the outlet nipple as a unit;

the connector nut retaining the nozzle body at a spaced axial distance from a seat surface of the outlet nipple when the connector nut is tightened on the outlet nipple to form a fluid seal therebetween;

the opposite end of the nozzle body having an outlet nozzle tip therein for directing a stream of fluid at an inclined angle to the common axis of the nozzle body and the nut;

the nozzle body having a fluid passageway connecting the nozzle tip and an outlet opening on the outlet nipple to permit fluid to flow from the outlet opening of the nipple and through an outlet orifice of the nozzle tip; and a seal member disposed between the nozzle body and the nut to prevent fluid from leaking from between the nut and the nozzle body while permitting the nozzle body to be rotated relative to the nut.

* * * * *